US006131432A

United States Patent [19]

Miyata et al.

[11] Patent Number: 6,131,432

[45] Date of Patent: Oct. 17, 2000

[54] METHOD OF MANUFACTURING METAL FOIL

[75] Inventors: Takashi Miyata; Tsutomu Matsubara; Yasuhiro Yamaguchi; Akinobu Kamimaru; Masaharu Saisu, all of Chiba, Japan

[73] Assignee: Kawasaki Steel Corporation, Hyogo, Japan

[21] Appl. No.: 09/424,301

[22] PCT Filed: Mar. 23, 1999

[86] PCT No.: PCT/JP99/01444

§ 371 Date: Nov. 22, 1999

§ 102(e) Date: Nov. 22, 1999

[87] PCT Pub. No.: WO99/48627

PCT Pub. Date: Sep. 30, 1999

[30] Foreign Application Priority Data

Mar. 23, 1998 [JP] Japan ..... 10-074692

[51] Int. Cl.[7] ..... B21B 39/20

[52] U.S. Cl. ..... 72/365.2; 72/252.5

[58] Field of Search ..... 72/252.5, 365.2, 72/366.2, 229

[56] References Cited

U.S. PATENT DOCUMENTS

| | | | |
|---|---|---|---|
| 4,332,192 | 6/1982 | Joutsjoki | 72/240 |
| 4,591,259 | 5/1986 | Kuo et al. | 72/160 |
| 4,597,326 | 7/1986 | Tanpani | 72/243 |
| 4,991,499 | 2/1991 | Kusters | 72/245 |
| 5,706,690 | 1/1998 | Connolly | 72/229 |
| 5,746,081 | 5/1998 | Klamma, et al. | 72/229 |

FOREIGN PATENT DOCUMENTS

| | | |
|---|---|---|
| 62-101304 | 5/1987 | Japan . |
| 1-197004 | 8/1989 | Japan . |
| 3-294010 | 12/1991 | Japan . |

*Primary Examiner*—Rodney A. Butler
*Attorney, Agent, or Firm*—Young & Thompson

[57] ABSTRACT

A process for manufacturing a metal foil by effecting rolling with a high efficiency without making any defectively shaped product. A metal foil having a thickness of 0.2 mm or less is manufactured after a plurality of passes of cold rolling by using soft work rolls from the first pass to the pass preceding the kissing pass during which the kissing of rolls is likely to occur, using hard work rolls for carrying out the kissing pass with a reduction in thickness of over 30%, and using soft work rolls for carrying out the last, or the last two passes with a reduction of 20% or less. Judgment is made again as to the likelihood of any roll kissing when hard rolls are used, and the pressure to be applied for the kissing pass is controlled in accordance with the result of such judgment.

13 Claims, 4 Drawing Sheets

PART B ENLARGED

METHOD OF MANUFACTURING METAL FOIL

TECHNICAL FIELD

This invention relates to a process for manufacturing a metal sheet, and more particularly to a process for cold rolling a sheet of steel, aluminum, an aluminum alloy, copper, a copper alloy, or another metallic material for manufacturing, among others, a metal foil having a thickness of 0.2 mm or less. The metal foil will be used as a material for electronic devices, a heat resisting material, a material for interior decoration, a material for automobile parts, or a material for use in other fields of industry.

BACKGROUND ART

If a rolled material has its thickness reduced to a critical level, a further reduction of its thickness promotes the elastic deformation of work rolls and makes any further rolling impossible. This critical thickness is called the minimum rollable thickness, and is defined by the following equation:

$$h_{min}=3.58\cdot D\cdot\mu\cdot km/E \quad (1)$$

where $h_{min}$=minimum rollable thickness (mm), D=roll diameter (mm), $\mu$=coefficient of friction between the rolls and the rolled material, km=mean deformation resistance of the rolled material (kgf/mm$^2$), and E=Young's modulus of the rolls (kgf/mm$^2$).

The minimum rollable thickness resulting from the mutual contact, or kissing of the upper and lower rolls at the opposite ends of the roll barrels is defined by the equation (2):

$$h_{min}=(C/8)\cdot P\cdot(2-lnZ) \quad (2)$$

where $C=16\ (1-\nu^2)/\pi E$, $Z=(L'^2/b^2)\cdot(B+b)/(B-b)$, L'=projected contact length (mm), B=barrel length of the rolls (mm), b=sheet breadth (mm), P=rolling force (kgf), $\nu$=Poisson's ratio of the rolls. (See, for example, The Third Edition of Iron & Steel Handbook, III (1) Fundamentals of Rolling-Steel Sheets, Maruzen Publishing Co., page 42.)

According to the equation (1), the minimum rollable thickness is in direct proportion to the roll diameter, while it is in inverse proportion to the Young's modulus of the rolls according to the equations (1) and (2), and it is, therefore, usual practice to employ work rolls having a small diameter and a high Young's modulus for rolling a metal foil to make the minimum rollable thickness smaller, as compared with the rolls which are usually employed for cold rolling (to make a sheet having a thickness of, say, 0.2 mm or larger). Examples of the work rolls having a high Young's modulus are ceramic and ultrahard alloy rolls. (See, for example, "Plasticity and Working", Vol. 2, No. 9, page 325 to 334, or Vol. 9, No. 84, page 20 to 29.)

The rolling force per unit width, p (kgf/mm), is expressed by the following equation:

$$p=km\cdot(R'\cdot\Delta h)^{1/2}\cdot Qp \quad (3)$$

where Qp is the rolling force function, and R' is the flattened roll radius (mm) as expressed by the following Hitchcock's equation:

$$R'=R\cdot(1+C\cdot p/\Delta h) \quad (4)$$

where R=roll radius (mm), and $\Delta h$=reduced thickness (sheet thickness on the inlet side or before rolls, hi-thickness on the outlet side or therafter, $h_0$) (mm). (See, for example, The Third Edition of Iron & Steel Handbook, III (1) Fundamentals of Rolling-Steel Sheets, Maruzen Publishing Co., page 41.)

As C in the equation (4) is the decreasing function of E, the rolls having a higher Young's modulus E have a smaller flattened radius R', and are also less bent. If the rolls are not satisfactorily flattened or bent for absorbing the factors having an adverse effect on the shape of a product (e.g. lack of uniformity in rolling pressure along the sheet breadth, and its variation with time), it is likely that a product having a defective shape may be obtained. Therefore, Japanese Patent Application Laid-Open No. Hei 1-197004(1989), for example, proposes the use of work rolls having a Young's modulus of 31,000 to 54,000 kgf/mm$^2$ for the last pass in the manufacture of a metal foil by continuous rolling.

The use of rolls having an upper limit on their Young's modulus as proposed is, however, a disadvantage when it is desirable to decrease the number of passes between rolls and thereby achieve an improved rolling efficiency. The decrease in number of passes necessarily calls for an increase in reduction of thickness per pass and thereby an elevated rolling pressure.

As it is obvious from the equation (2) that the minimum rollable thickness, $h_{min}$, resulting from the kissing of rolls is in direct proportion to the rolling pressure and in inverse proportion to the Young's modulus of the rolls, it is limited by the maximum Young's modulus of the rolls if the rolling pressure is raised to the extent allowed by the mill capacity, or the yield point of the rolls, and it is impossible to obtain a metal foil having a smaller thickness. If the Young's modulus of the rolls has an upper limit, the reduction of thickness per pass has its own upper limit which makes it difficult to decrease the number of passes and thereby achieve a high rolling efficiency.

Japanese Patent Application Laid-Open No. Hei 10-34205 (1998) proposes that work rolls having a Young's modulus exceeding 54,000 kgf/mm$^2$ be employed for carrying out at least the last pass with a reduction in thickness of 30% or less when manufacturing a cold rolled metal foil having a thicness of 0.2 mm or less. The use of such hard rolls as have a Young's modulus exceeding 54,000 kgf/mm$^2$ is, however, likely to result in a rolled product having an irregular shape which is difficult to rectify satisfactorily.

It is, therefore, an object of this invention to provide a process which can manufacture a metal sheet, and particularly a metal foil by rolling with a high efficiency, while not allowing any product having a defective shape to be made.

DISCLOSURE OF THE INVENTION

This invention is a process for manufacturing a metal sheet, and particularly a metal foil having a thickness of 0.2 mm or less, by a plurality of passes of cold rolling, which includes using soft work rolls from the first pass of rolling to the pass preceding the pass during which the kissing of the rolls is likely to occur, using hard work rolls for carrying out with a reduction in thickness of over 30% the pass during which the kissing of the rolls is likely to occur, and using soft work rolls for carrying out the last, or the last two passes with a reduction in thickness of 20% or less. When the hard work rolls are used, judgment is made again beforehand to ascertain if the kissing of the rolls is likely to occur, and the results thereof are relied upon for controlling the pressure to be applied for carrying out the corresponding pass.

The soft work rolls preferably have a Young's modulus of 21,000 kgf/mm$^2$, inclusive, to 31,000 kgf/mm$^2$, exclusive, while the hard ones preferably have a Young's modulus exceeding 54,000 kgf/mm$^2$.

BEST MODE FOR CARRYING OUT THE INVENTION

Figure 1:
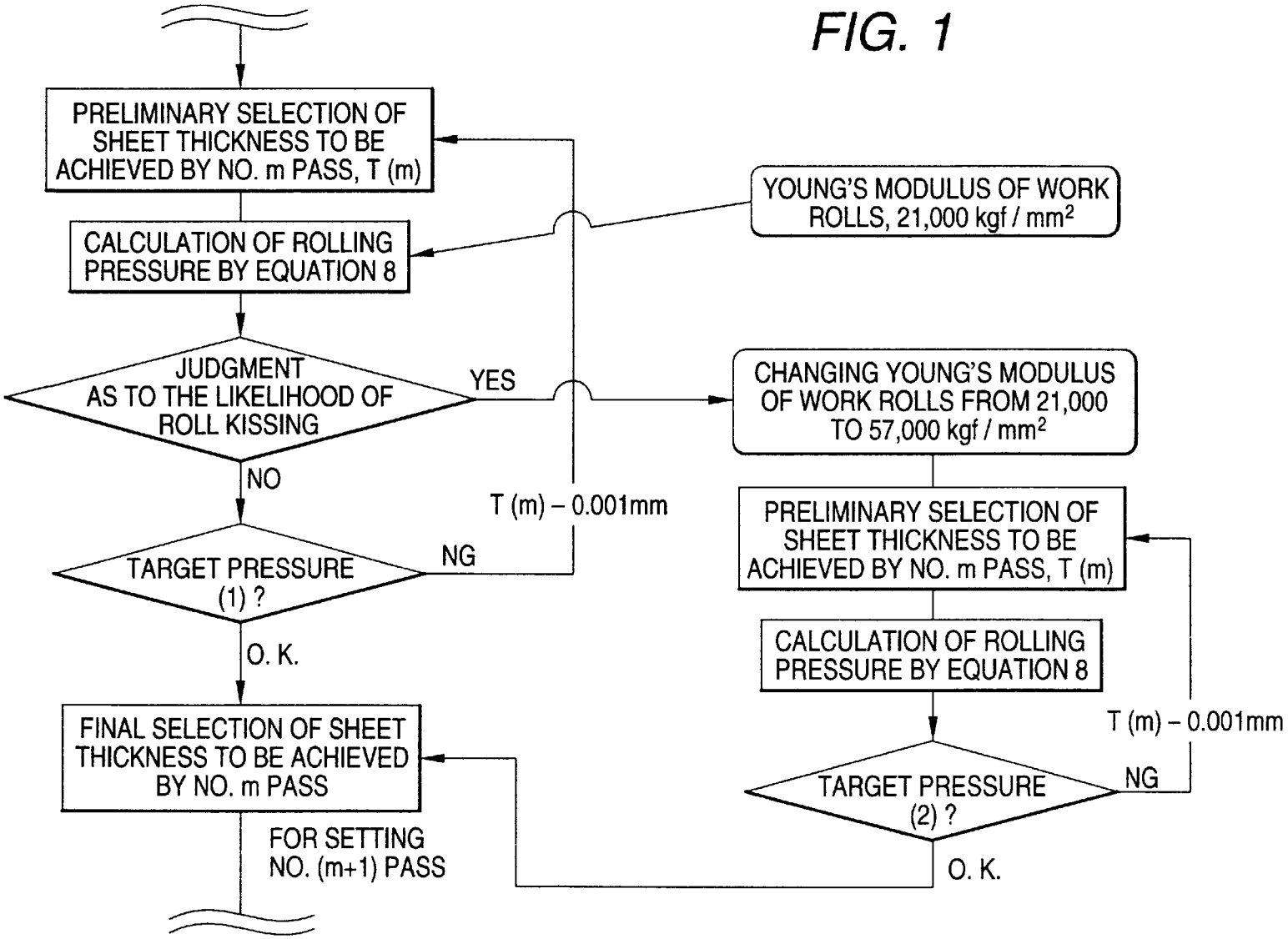
FIG. 1 is a flowchart illustrating a method of calculating a pass schedule embodying this invention.

According to this invention, a process for manufacturing a metal sheet, and particularly a metal foil having a thickness of 0.2 mm or less, by a plurality of passes of cold rolling includes using soft work rolls from the first pass of rolling to the pass preceding the pass during which the kissing of the rolls is likely to occur, using hard work rolls for carrying out with a reduction in thickness of over 30% the pass during which the kissing of the rolls is likely to occur, and using soft work rolls for carrying out the last, or the last two passes with a reduction in thickness of 20% or less.

Although soft work rolls are inexpensive, they cannot be employed for carrying out all the passes, since their kissing occurs during the middle and later passes after a considerable reduction in thickness of a rolled product, and brings about so high a rolling pressure and so high a load on the mill that it is essential to increase the number of passes instead of adopting an increased percentage of reduction in thickness per pass. The first pass during which the kissing of the rolls is likely to occur will be called the kissing pass.

According to this invention, however, soft work rolls are used for carrying out rolling from the first pass to the pass preceding the pass during which the kissing of the rolls is likely to occur, and hard work rolls are used for carrying out a reduction in thickness of over 30% during the pass during which the kissing of the rolls is likely to occur. The hard rolls do not kiss each other, but make the necessary reduction in thickness without carrying out any additional pass. If they are intended for making a reduction of 30% or less, however, it will be necessary to carry out an additional pass or passes for making the necessary reduction.

The use of hard work rolls makes it so difficult to control the shape of a product that it is likely to have an irregular shape, such as a stretched edge or middle portion, but we, the inventors of this invention, have found that any such irregular shape can be corrected satisfactorily if a reduction of 20% or less is effected by employing soft work rolls for the last, or the last two passes. A reduction of over 20% will, however, result in a rolled product retaining an irregular shape.

High-speed steel rolls are preferably used as the soft work rolls, and while they may have a Young's modulus of 21,000 to 31,000 kgf/mm$^2$, it is preferable from an economical standpoint to use rolls having a Young's modulus lower than 31,000 kgf mm$^2$. Rolls of an ultrahard alloy, such as a WC—Co alloy, are preferably used as the hard work rolls, and it is desirable to use ones having a Young's modulus exceeding 54,000 kgf/mm$^2$ in order to ensure that no additional pass be necessary.

Description will now be made of a method of determining the kissing pass. The sheet thickness which may allow the kissing of rolls to occur is calculated by an equation assuming in accordance with the theory of elasticity that a flat load may bear on an elastically semi-infinite body (work roll) [see, for example, "The Theory of Rolling and its Application", The Japan Iron & Steel Association (1969)].

Figure 3:
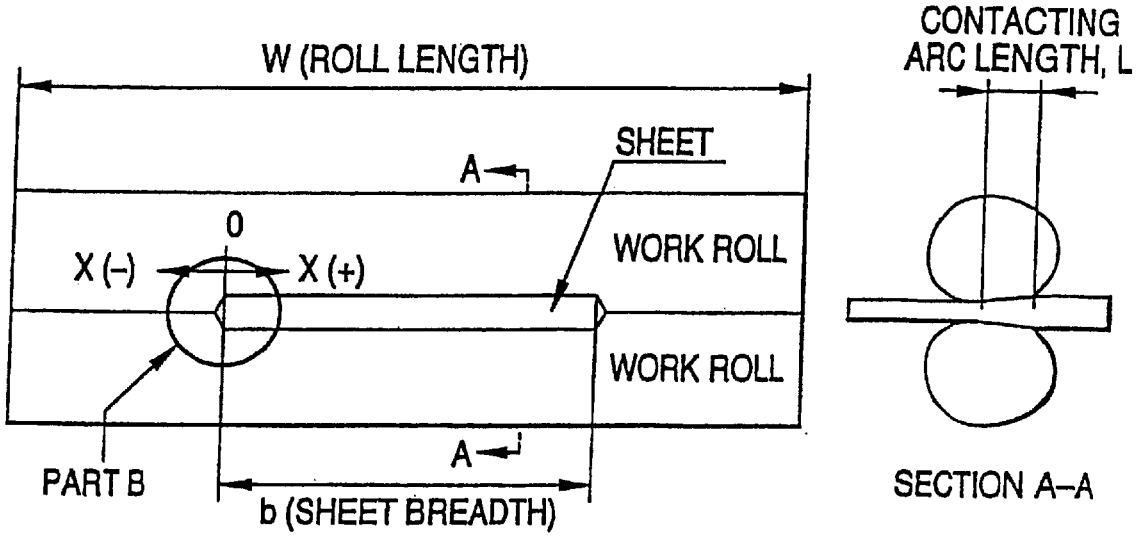
FIG. 3 is a set of diagrams showing the kissing of work rolls.
Figure 3:
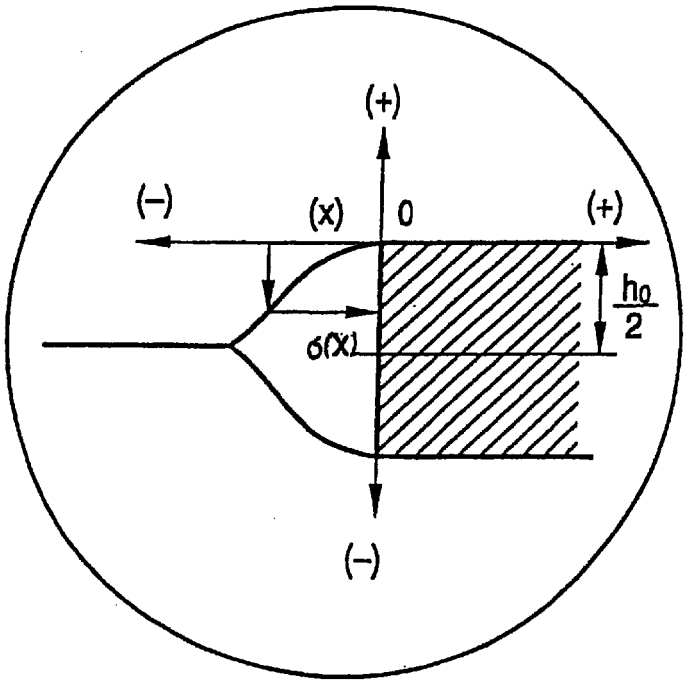

FIG. 3 is a diagrammatical illustration of the kissing of work rolls. If one edge of the material to be rolled is employed as the origin of the x-axis extending along its breadth as shown in FIG. 3, and if x<0, the displacement δ(x) of the rolls is expressed by the following equation:

$$\delta(x) = \frac{(1-\nu^2)}{\pi E}\cdot P'\cdot\left\{L\cdot\log\frac{2(b-x)}{\sqrt{x^2+L^2}-x} + L + x\cdot\log\frac{L+\sqrt{x^2+L^2}}{-x}\right\} \quad (5)$$

$$\text{where } L = \sqrt{(h_1-h_0)\cdot R'} \quad (6)$$

$$P' = P\cdot\eta = k_m\sqrt{R'\cdot\Delta h}\cdot Q_P\eta \quad (7)$$

$$Q_p = Q_{H111} = 1.08 + 1.79\cdot r_d\mu\sqrt{R'/h_1} - 1.02\cdot r_d \quad (8)$$

$$\eta \text{ (term for correction by tension)} = \left(1-\frac{t_1}{k_m}\right)\cdot\left\{1.05 + 0.1\cdot\frac{\left(1-\frac{t_0}{k_m}\right)}{\left(1-\frac{t_1}{k_m}\right)} - 0.15\cdot\frac{\left(1-\frac{t_1}{k_m}\right)}{\left(1-\frac{t_0}{k_m}\right)}\right\} \quad (9)$$

$r_d$=reduction in thickness, $t_1$=unit tension on the inlet side (kgf/mm$^2$), and $t_0$=unit tension on the outlet side (kgf/mm$^2$)

The sheet thickness ho which satisfies the following equation (10) is judged as the sheet thickness which is likely to cause the kissing of the rolls, and the corresponding pass is determined as the kissing pass:

$$\delta(x) + h_0/2 < 0 \quad (10)$$

Figure 4:
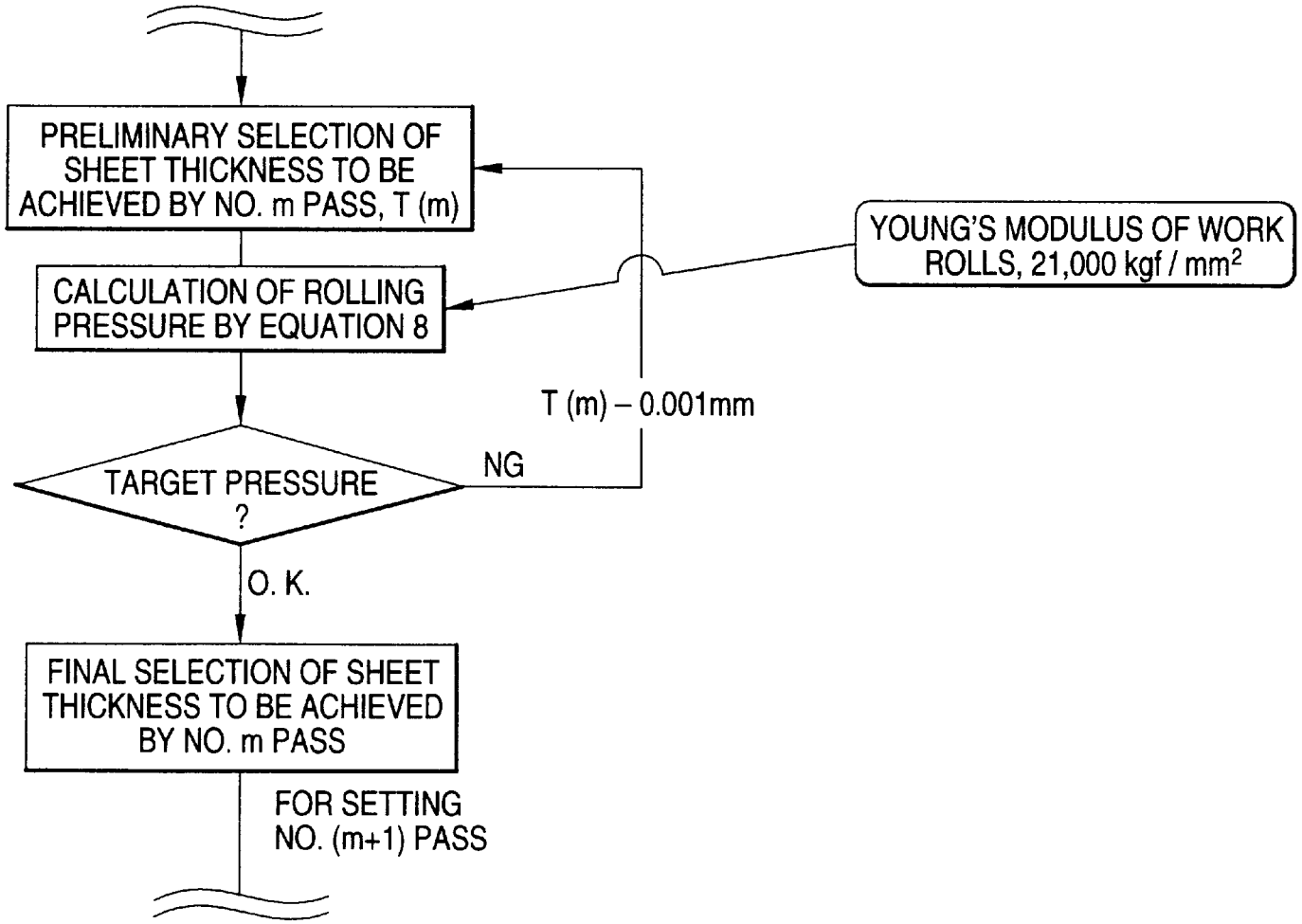
FIG. 4 is a flowchart illustrating a known method of calculating a pass schedule.

Such judgement and determination are made at the time of the calculation of a pass schedule prior to rolling. For the calculation of a pass schedule prior to rolling, it has hitherto been usual to repeat for each pass the step of calculating the rolling pressure by varying the sheet thickness on the outlet side until the calculated pressure reaches the target pressure, and determine the corresponding sheet thickness as the target sheet thickness on the outlet side, as shown in FIG. 4. In order to maintain a flat shape on a sheet as rolled, it has been necessary to adopt a fixed crown ratio (the crown of a sheet as divided by its thickness) for each pass, and it has, therefore, been necessary to control the bend of the work rolls by the rolling pressure to a target value for each pass, so that a sheet having a good shape may be obtained if the rolling force for each pass is controlled to a target value.

Figure 2:
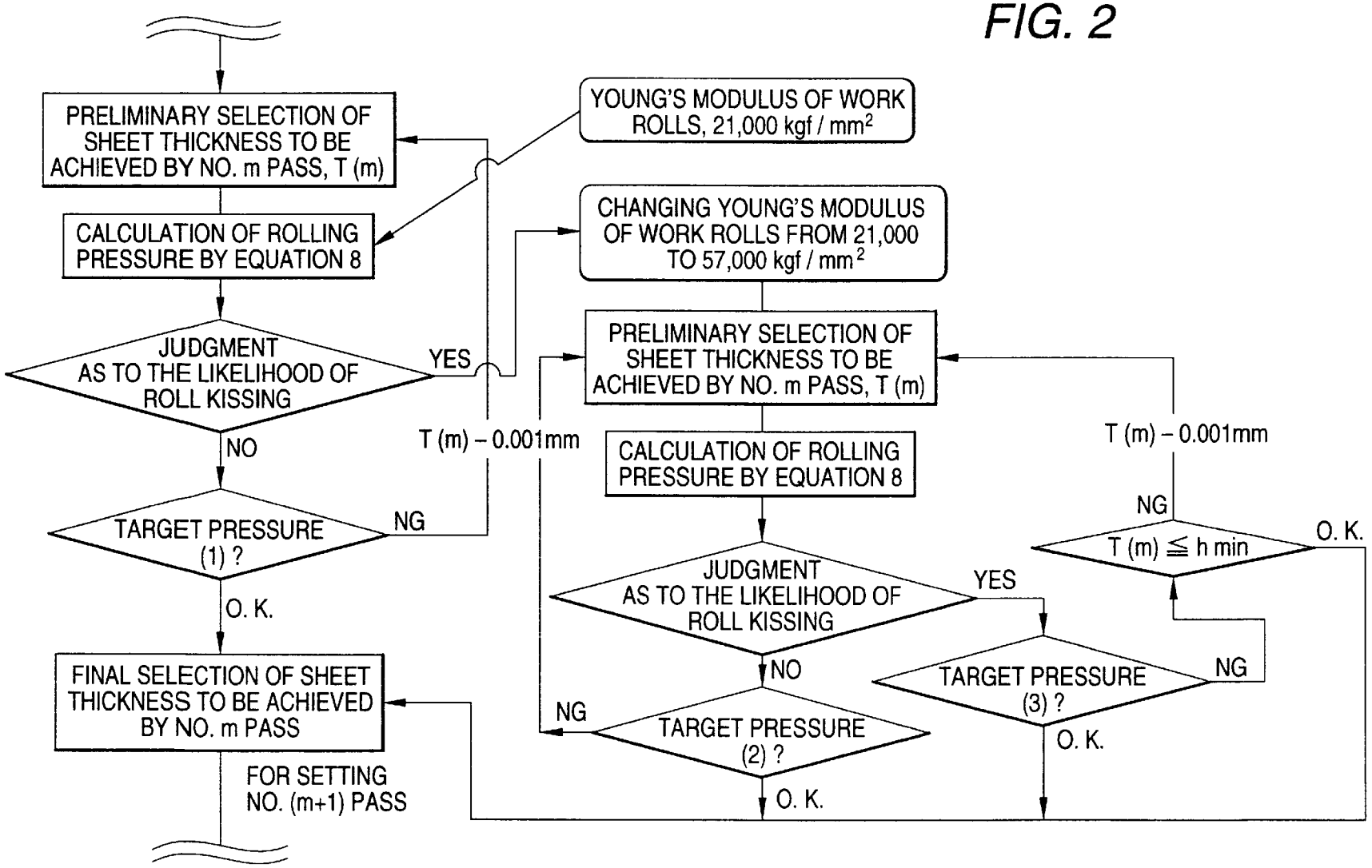
FIG. 2 is a flowchart illustrating another method of calculating a pass schedule embodying this invention.

According to this invention, however, judgment is made as to the kissing of work rolls in accordance with the equations (5) to (10) after the calculation of the force, and if the kissing of the rolls is likely to occur, the calculation is repeated for determining the target sheet thickness on the outlet side by changing the Young's modulus of the rolls from the value of soft rolls (e.g. 21,000 kgf/mm) to that of hard rolls (e.g. over 54,000 kgf/mm$^2$), as shown in FIG. 1. The pass corresponding to any such change is determined as the kissing pass. A rolled sheet having a still better shape can be obtained if judgment as to the kissing of the work rolls is made again after the Young's modulus of the rolls is changed to the value of hard rolls, and if a different target pressure is set when the kissing of the rolls is likely to occur and when it is not, as shown in FIG. 2.

Embodiment:

Attempts were made to manufacture a stainless steel foil having a thickness of 0.050 mm by cold rolling a sheet of SUS304 or SUS430 having a thickness of 0.300 mm and a width of 960 mm in a 20-stage Sendzimir mill with work rolls having a diameter of 56 mm. A known process was carried out by employing high-speed steel rolls having a Young's modulus of 21,000 kgf/mm$^2$ for all the passes, and a lower percentage reduction in thickness from the fifth pass was carried out because of the kissing of the rolls, finally a total of eight passes were required for making a final product, as shown in Table 1.

A process embodying this invention, however, made it possible to decrease three passes by employing rolls of an ultrahard WC—Co alloy having a Young's modulus of 57,000 kgf/mm$^2$ for carrying out the third and fourth passes (the kissing passes) with a reduction of over 30%, while employing high-speed steel rolls for carrying out the last pass with a reduction of below 20%, as shown in Table 1. None of the products of the known process, or the process embodying this invention was irregular in shape as having a stretched edge or middle portion.

The mill showed an overall rolling efficiency of 0.3 ton/hour when the known process was employed for manufacturing a stainless steel foil having a thickness of 0.2 mm or less, but the process embodying this invention enabled it to show an improved efficiency of 0.5 ton/hour.

Although the foregoing description has been of the processes employed for reverse rolling, it is needless to say that this invention is also effective for uni-directional continuous rolling with a plurality of stands (tandem rolling).

TABLE 1

| | | Number of passes | | | | | | | | |
|---|---|---|---|---|---|---|---|---|---|---|
| | | 0 | 1 | 2 | 3 | 4 | 5 | 6 | 7 | 8 |
| Known process | Thickness (μm) | 300 | 205 | 150 | 115 | 90 | 75 | 64 | 56 | 50 |
| | Reduction (%) | | 31.7 | 26.8 | 23.3 | 21.7 | 16.7 | 14.7 | 12.5 | 10.7 |
| | Young's modulus of work rolls (kgf/mm$^2$) | | | | | 21000 | | | | |
| Process embodying the invention | Thickness (μm) | 300 | 203 | 140 | 86 | 57 | 50 | | | |
| | Reduction (%) | | 32.4 | 30.9 | 38.5 | 33.6 | 12.6 | | | |
| | Young's modulus of work rolls (kgf/mm$^2$) | | 21000 | | 57000 | | 21000 | | | |

INDUSTRIAL APPLICABILITY

It is an outstanding advantage of this invention that it can decrease the number of passes between work rolls for the manufacture of a could rolled metal sheet or foil without making any undesirably shaped product.

What is claimed is:

1. A process for manufacturing a metal foil by cold rolling a metal sheet through a plurality of passes after selecting a target sheet thickness to be achieved by each pass by repeating the step of calculating a rolling pressure for each pass by varying said target sheet thickness until said calculated pressure reaches a target value, said process comprising making judgment as to the likelihood of any kissing of work rolls after said calculating step, changing the Young's modulus of said rolls from the value of soft rolls to that of hard rolls if said judgment has affirmed said likelihood, and repeating said calculating step again until said calculated pressure reaches a new target value, so that a new target sheet thickness may be selected.

2. A process as set forth in claim 1, further including making said judgment again after said changing of said Young's modulus, and controlling the target pressure for a kissing pass in accordance with the result of said judgment.

3. A process as set forth in claim 1, wherein said judgment is made in the affirmative if the following relationship (1) is satisfied:

$$\delta(x)+h_0/2<0 \quad (1)$$

where $\delta(x)$=displacement of the work rolls, and $h_0$=sheet thickness to be achieved by a kissing pass.

4. A process for manufacturing a metal sheet by a plurality of passes of cold rolling, which comprises using soft work rolls from the first pass of rolling to the pass preceding the kissing pass during which the kissing of the rolls is likely to occur, using hard work rolls for carrying out said kissing pass, and using soft work rolls for carrying out the last, or the last two passes.

5. A process as set forth in claim 4, further including making judgment as to the likelihood of said kissing before using said hard work rolls, and controlling a target pressure to be applied for said kissing pass in accordance with the result of said judgment.

6. A process as set forth in claim 4, wherein said sheet has a thickness of 0.2 mm or less, and said hard work rolls are used for achieving a reduction in thickness of over 30%.

7. A process as set forth in claim 4, wherein said sheet has a thickness of 0.2 mm or less, and said soft work rolls are used for achieving a reduction in thickness of 20% or less.

8. A process as set forth in claim 4, wherein said soft work rolls have a Young's modulus of from 21,000 kgf/mm$^2$, inclusive, to 31,000 kgf/mm$^2$, exclusive.

9. A process as set forth in claim 4, wherein said hard work rolls have a Young's modulus exceeding 54,000 kgf/mm$^2$.

10. A process as set forth in claim 5, wherein said sheet has a thickness of 0.2 mm or less, and said hard work rolls are used for achieving a reduction in thickness or over 30%.

11. A process as set forth in claim 5, wherein said sheet has a thickness of 0.2 mm or less, and said soft work rolls are used for achieving a reduction in thickness of 20% or less.

12. A process as set forth in claim 5, wherein said soft work rolls have a Young's modulus of from 21,000 kgf/mm$^2$, inclusive, to 31,000 kgf/mm$^2$, exclusive.

13. a process as set forth in claim 5, wherein said hard work rolls have a Young's modulus exceeding 54,000 kgf/mm$^2$.

* * * * *